United States Patent [19]

Rogers, Jr.

[11] 4,452,469

[45] Jun. 5, 1984

[54] SEAT BELT JUNCTION RING

[75] Inventor: Lloyd W. Rogers, Jr., Utica, Mich.

[73] Assignee: General Motors Corporation, Detroit, Mich.

[21] Appl. No.: 348,915

[22] Filed: Feb. 16, 1982

[51] Int. Cl.[3] ..... B60R 21/00

[52] U.S. Cl. ..... 280/801; 280/808; 297/476

[58] Field of Search ..... 280/801, 802, 803, 804, 280/805, 806, 807, 808; 297/468, 476, 479, 483

[56] References Cited

U.S. PATENT DOCUMENTS

| | | | |
|---|---|---|---|
| 3,258,293 | 4/1964 | Sharp | 297/389 |
| 3,888,541 | 6/1975 | Stephenson | 297/388 |
| 3,957,283 | 5/1976 | Pocobello | 297/385 |
| 4,189,002 | 2/1980 | Lazich et al. | 280/801 |
| 4,253,702 | 3/1981 | Lehr | 280/801 |
| 4,291,918 | 9/1981 | Finn et al. | 297/483 |
| 4,294,467 | 10/1981 | Frantom | 280/801 |
| 4,314,715 | 2/1982 | Duguet et al. | 280/801 |

*Primary Examiner*—Richard A. Bertsch
*Attorney, Agent, or Firm*—Charles E. Leahy

[57] ABSTRACT

A junction ring adapted for use in a seat belt system wherein a continuous-loop belt is slidable through the junction ring to define shoulder belt and lap belt portions includes a housing having slots mounting a pin for movement toward and away from the buckle. The belt passes around the pin. A buckle is selectively engageable with the junction ring to establish the lap belt and shoulder belt in occupant restraining positions across the seat. The shoulder belt is wound by a seat belt retractor having a tension reliever permitting introduction of slack into the shoulder belt. A spring urges the pin in the direction toward the buckle so that the belt is carried into frictional engagement with a friction member to provide a one-way friction detent which prevents transference of the shoulder belt slack into the lap belt so that the lap belt remains taut about the occupant. The spring acting on the pin yields upon the onset of an occupant restraint load to permit movement of the pin away from the buckle and the friction member so that the continuous-loop belt is permitted to pass through the junction ring to adjust the relative restraint lengths of the lap and shoulder belt portions. The frictional engagement of the friction member with the belt is terminated upon disengagement of the junction ring from the buckle so that the belt may pass freely therethrough.

3 Claims, 5 Drawing Figures

SEAT BELT JUNCTION RING

The invention relates to an occupant restraint belt system having a continuous-loop belt and, more particularly, provides a junction ring assembly which is effective when the belt is buckled in the occupant restraint position to permit belt transference through the junction ring only in the direction to tighten the lap belt so that slack introduced into the shoulder belt by a tension relieving shoulder belt retractor cannot be transferred into the lap belt.

BACKGROUND OF THE INVENTION

It is known in vehicle seat belt systems to employ a continuous loop of belt having a junction ring slidable therealong to adjust the relative restraint lengths of the lap and shoulder belt portions. It is also known to provide a retractor mounting the shoulder belt end of the continuous loop belt and to provide a tension relieving device within the shoulder belt retractor so that the shoulder belt can be held against rewinding at a certain slacked length to enhance occupant comfort.

It would be desirable in such an occupant restraint system to provide a junction ring assembly which would function to prevent the transference of this slack from the shoulder belt into the lap belt. Furthermore, it would be desirable to provide a junction ring assembly which would free the continuous loop belt for passage through the junction ring upon the onset of an occupant restraint load to permit adjustment of the relative restraint lengths of the lap and shoulder belts to obtain optimum occupant restraint effectiveness.

SUMMARY OF THE INVENTION

The invention provides a junction ring adapted for use in a seat belt system wherein a continuous loop belt is slidable through the junction ring to define shoulder belt and lap belt portions. A buckle is selectively engageable with the junction ring to establish the lap belt and shoulder belt in restraining positions across the seat to restrain the occupant. The shoulder belt is wound by a seat belt retractor having a tension reliever permitting introduction of slack into the shoulder belt. The junction ring includes a housing mounting a pin having the continuous loop belt passing therearound. The pin is mounted on the housing for movement toward and away from the buckle. A spring urges the pin in the direction toward the buckle. A friction member is adapted to frictionally engage with the belt on the opposite side thereof from the pin when the junction ring is engaged with the buckle to provide a one-way friction detent which enables the introduction of slack into the shoulder belt by the tension reliever of the seat belt retractor and yet prevents transference of the slack into the lap belt so that the lap belt remains taut about the occupant. The spring acting on the pin yields upon the onset of an occupant restraint load to permit movement of the pin in a direction away from the buckle and the friction member so that the continuous loop belt is permitted to pass around the pin and through the junction ring to adjust the relative restraint lengths of the lap and shoulder belt portions. The frictional engagement of the friction member with the belt is terminated upon disengagement of the junction ring from the buckle so that the belt may pass freely therethrough.

BRIEF DESCRIPTION OF THE DRAWINGS

These and other objects, features and advantages of the invention will become apparent upon consideration of the description of the preferred embodiment and the appended drawings in which.

DESCRIPTION OF THE PREFERRED EMBODIMENT

Figure 1:
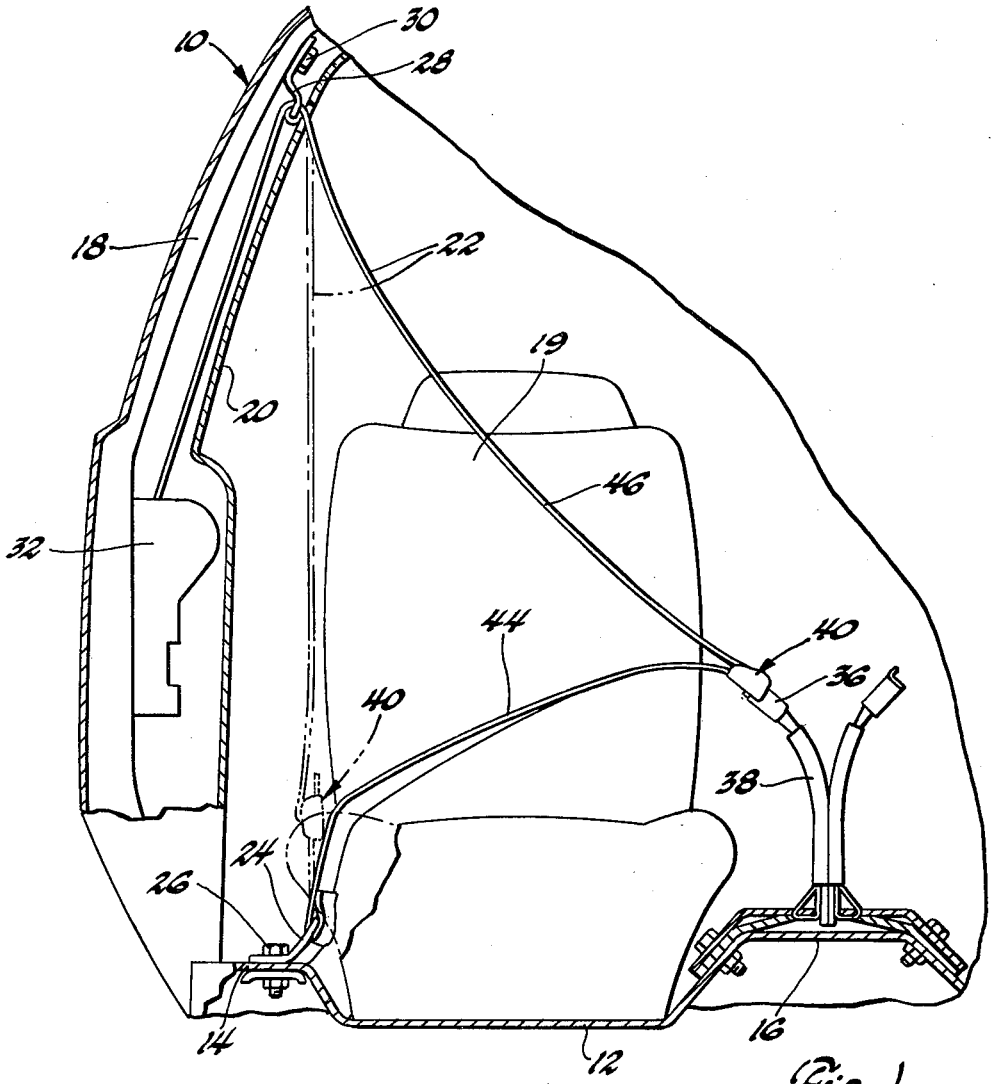
FIG. 1 is a longitudinal section view taken through a vehicle body having an occupant restraint system including the junction ring assembly of this invention.

Referring to FIG. 1, the vehicle body indicated by numeral 10 includes a floor 12 having an outboard sill 14 and an inboard transmission tunnel 16. A pillar 18 extends vertically adjacent the rear of the seat 19 outboard thereof and includes a trim panel 20 facing the occupant compartment of the vehicle body.

An occupant restraint system includes a continuous loop restraint belt 22 having a lower end attached to the sill 14 by an anchor plate 24 and bolt assembly 26. The upper end of the continuous loop belt 22 passes through a slide loop 28 attached to the pillar 18 by a bolt 30 and downwardly to a shoulder belt retractor 32 which normally winds the continuous loop belt 22 to a phantom line indicated stowed position extending generally vertically along the trim panel 20.

A seat belt buckle 36 is mounted on the transmission tunnel 16 by a semi-rigid anchor strap 38. A junction ring 40 is slidable along the continuous loop belt 22 and divides the continuous loop belt 22 into a lap belt 44 and a shoulder belt 46 when the junction ring 40 is engaged within the buckle 36.

Figure 2:
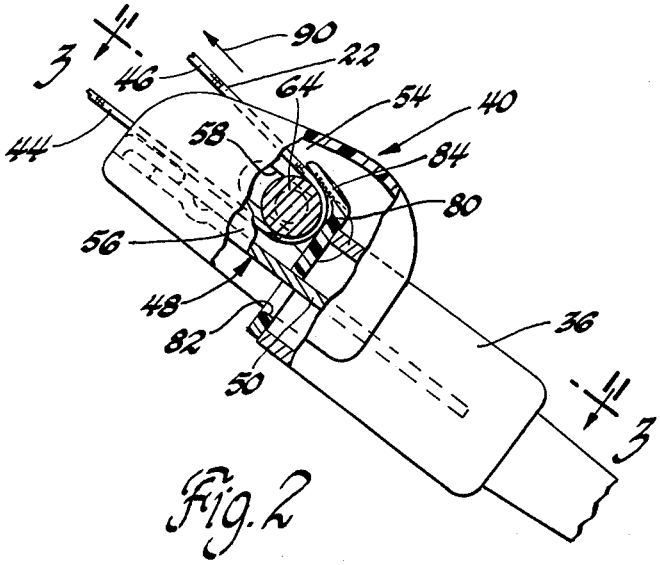
FIG. 2 is an enlarged fragmentary view of the junction ring and buckle and having parts broken away and in section.
Figure 3:
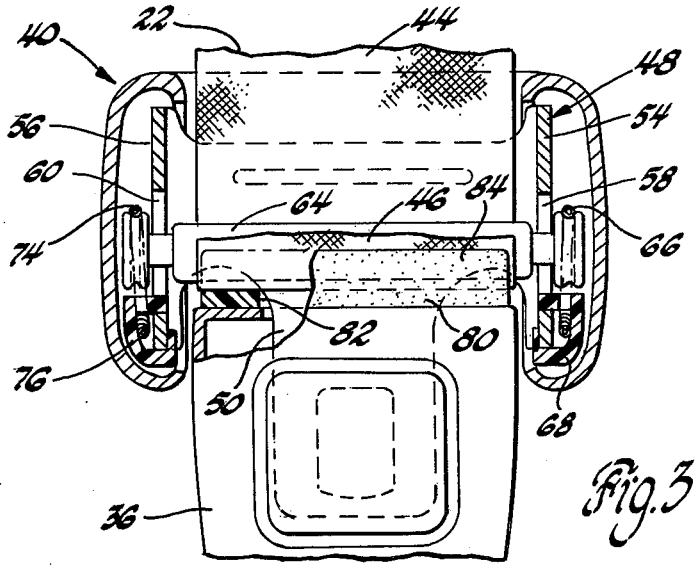
FIG. 3 is a sectional view taken in the direction of arrows 3—3 of FIG. 2.

Referring to FIGS. 2 and 3, it is seen that the junction ring includes a stamped steel frame 48 including an apertured tongue portion 50 which is adapted for insertion into the buckle 36. The buckle 36 has a conventional latch for engaging with the apertured tongue portion 50 and a pushbutton for releasing the latch to enable disengagement of the junction ring 40 from the buckle 36. The frame 48 also has a pair of spaced apart upturned flanges 54 and 56 having aligned longitudinal extending slots 58 and 60. A pin 64 extends between the flanges 54 and 56 and projects slidably through the slots 58 and 60 to enable movement of the pin toward and away from the buckle 36. The continuous loop belt 22 passes around the pin 64 as best seen in FIG. 2.

As seen in FIG. 3, a loop coil spring 66 wraps around the end of the pin 64 and is anchored on the flange 54 by a plastic spring retainer 68. A like loop coil spring 74 encircles the opposite end of the pin 64 and is mounted on the flange 56 by a plastic spring retainer 76. The springs 66 and 74 cooperate to urge the pin 64 in the direction toward the buckle 36.

Figure 4:
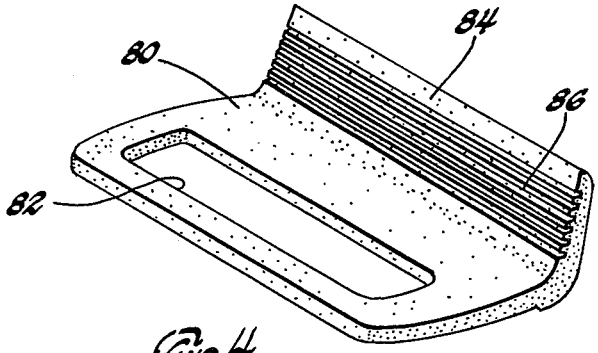
FIG. 4 is a perspective view of the friction member which engages the belt when the junction ring is engaged in the buckle.

As best seen in FIGS. 2 and 4, a friction member 80 is suitably mounted on the buckle 36 and has an aperture 82 which registers with the opening in the end of the buckle 36 to receive the apertured tongue portion 50 of the junction ring frame 48. The friction member 80 also has a friction arm 84 which projects from the buckle 36 and is adapted to overlie the pin 64 as best seen in FIG. 2. The springs 66 and 74 bias the pin 64 toward the buckle 36 so that the pin 64 carries the continuous loop belt 22 passing therearound into frictional engagement with the friction leg 84 of the friction member 80.

OPERATION

Referring to the phantom line indicated stowed position of FIG. 1, it will be understood that prior to engagement of the junction ring 40 with the buckle 36, the continuous loop belt 22 will be able to pass freely around the pin 64 so that the junction ring can be moved freely along the belt to facilitate positioning of the lap and shoulder belt portions about the seated occupant.

When the junction ring 40 is engaged with the buckle 36 by the insertion of the junction ring tongue portion 50 into the buckle 36, the friction leg 84 of the friction member 80 carried by the buckle 36 projects into overlying relationship with the pin 64 of the junction ring 40. The coil loop springs 66 and 74 cooperate to urge the pin 64 toward the buckle 36 so that the belt 22 is frictionally engaged by the teeth 86 on the friction arm 84. The pin 64 and teeth 86 cooperate to permit one way travel of the belt around the pin 64 in the direction of the arrow designated 90 to transfer any slack belt from the lap belt portion 44 to the shoulder belt portion 46.

After the occupant has engaged the junction ring 40 with the buckle 36 to establish the lap belt 44 and shoulder belt 46 in the occupant restraint positions, the occupant may set the tension reliever in the retractor 32 and thereby establish slack in the shoulder belt 46. This slack cannot be transferred into the lap belt 44 because the frictional engagement of the belt 22 between the pin 64 and the friction teeth 86 clamps the belt 22 against movement around the pin 64.

Upon the onset of a rapid vehicle deceleration condition in which the lap belt 44 and shoulder belt 46 restrain the seated occupant, a substantial occupant restraining load is imposed on the lap belt 44 and the shoulder belt 46. This substantial belt load overcomes the bias of the coil loop springs 66 and 74 and permits movement of the pin 64 along the slots 60 and 58 in the direction away from the friction member 80. Accordingly, the belt 22 moves away from frictional contact with the friction arm 84 and the continuous loop belt 22 is permitted to pass around the pin 64 to adjust the relative restraint lengths of the lap and shoulder belts. When the occupant restraint load is terminated, the coil loop springs 66 and 74 return the pin 64 to the position of FIG. 2.

Disengagement of the junction ring 40 from the buckle 36 as permitted by conventional manual depression of the buckle pushbutton permits bodily removal of the junction ring 40 away from the friction member 80 to restore the junction ring to the normal condition permitting free passage of the belt 22 around the pin 64.

DESCRIPTION OF A SECOND EMBODIMENT

Figure 5:
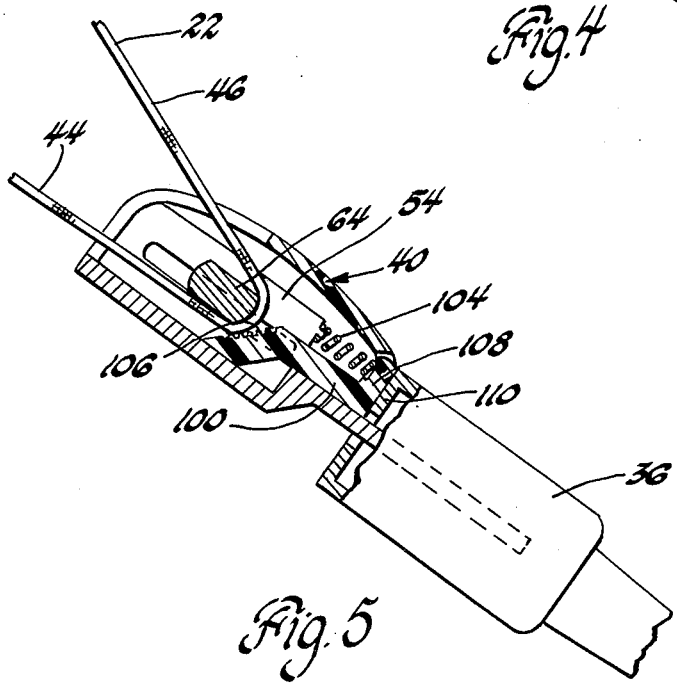
FIG. 5 is a view similar to FIG. 2 showing a second embodiment of the invention.

Referring to FIG. 5, there is shown a second embodiment of the invention in which like elements are designated by like numerals. In the embodiment of FIG. 5, the friction member designated 100, is also of injection molded plastic but is moveably mounted within the junction ring 40. A pair of coil compression springs, one of which is shown at 104 acts between the upturned flanges 54 and 56 to urge the friction member 100 in the direction to carry its friction teeth 106 and abutment portion 108 in the direction away from the pin 64. FIG. 5 shows the junction ring 40 engaged within the buckle 36 such that the wall 110 of the buckle 36 has acted upon the friction member abutment portion 108 to retract the friction member 100 within the junction ring 40 and thereby carry the friction teeth 106 into engagement with the continuous loop belt passing around the pin 64. Accordingly, slack introduced into the shoulder belt 46 cannot be transferred into the lap belt 44 because any such attempted movement is blocked by the wedging of the teeth 106 against that portion of the belt 22 clamped between the teeth 106 and the pin 64. However, upon the onset of an occupant restraint load, the pin 64 is permitted to move away from the friction teeth 106 as enabled by yielding of the loop coil springs 66 and 74, not shown in FIG. 5. Thus, it is seen that the embodiment of FIG. 5 differs from the embodiment of FIGS. 2–4 in that the friction member for engagement with the belt is moveably mounted on the junction ring instead of being fixedly mounted on the buckle housing.

Thus, it is seen that the invention provides a new and improved junction ring for a continuous loop belt system having a tension relieving shoulder belt retractor. More particularly, the junction ring functions to prevent transference of the slack introduced into the shoulder belt by the tension relieving retractor into the lap belt and yet frees the belt upon onset of an occupant restraint load so that the belt may transfer through the junction ring to adjust the relative occupant restraint lengths of the lap belt and shoulder belt portions.

The embodiments of the invention in which an exclusive property or privilege is claimed are defined as follows:

1. A junction ring adapted for use in a seat belt system wherein a continuous loop belt is slidable through the junction ring to define shoulder belt and lap belt portions, a buckle is selectively engageable with the junction ring to establish the lap and shoulder belt portions in restraining positions across the seat occupant, and the shoulder belt portion is wound by a seat belt retractor having a tension reliever permitting introduction of slack into the shoulder belt, said junction ring comprising:

a frame, a pin having the continuous loop belt passing therearound, means mounting the pin on the housing for movement toward and away from the buckle, spring means urging the pin in the direction toward the buckle, a friction member adapted to frictionally engage with the belt on the opposite side thereof from the pin when the junction ring is engaged with the buckle to provide a one way friction detent which enables the introduction of slack into the shoulder belt portion by the tension reliever of the seat belt retractor and yet prevents transference of the slack into the lap belt portion so that the lap belt portion remains taut about the occupant, said friction engagement of the friction member with the belt being terminated upon disengagement of the junction ring from the buckle so that the belt may pass freely therethrough, said spring means acting on the pin yielding upon the onset of an occupant restraint load to permit movement of the pin in the direction away from the buckle and the friction member so that the continuous loop belt is permitted to pass freely around the pin and through the junction ring to adjust the relative restraint lengths of the lap and shoulder belt portions.

2. A junction ring adapted for use in a seat belt system wherein a continuous loop belt is slidable through the junction ring to define shoulder belt and lap belt portions, a buckle is selectively engageable with the junction ring to establish the lap and shoulder belt portions in restraining positions across the seat occupant, and the shoulder belt portion is wound by a seat belt retractor having a tension reliever permitting introduction of slack into the shoulder belt, said junction ring comprising:

a frame having spaced apart upturned flanges defining slots and having a tongue portion adapted for latching engagement by the buckle, a pin mounted by the slots for movement toward and away from the buckle and having the continuous-loop belt passing therearound, spring means urging the pin in the direction toward the buckle, a friction member mounted on the buckle and having a toothed friction arm overlying the pin and the belt when the junction ring is engaged with the buckle, spring means urging the pin in the direction toward the buckle so that the belt is engaged between the pin and the toothed friction arm to provide a one-way friction detent which prevents transference of the tension relieving slack from the shoulder belt portion into the lap belt portion so that the lap belt portion remains taut about the occupant, said spring means yielding upon the onset of an occupant restraint load to permit movement of the pin away from the buckle and the friction member so that the continuous-loop belt is carried away from engagement with the toothed friction arm and permitted to pass freely around the pin and through the junction ring to adjust the relative restraint lengths of the lap and shoulder belt portions, said friction engagement of friction member with the belt being also terminated upon disengagement of the junction ring from the buckle so that the belt may pass freely through the junction ring.

3. A junction ring adapted for use in a seat belt system wherein a continuous loop belt is slidable through the junction ring to define shoulder belt and lap belt portions, a buckle is selectively engageable with the junction ring to establish the lap and shoulder belt portions in restraining positions across the seat occupant, and the shoulder belt portion is wound by a seat belt retractor having a tension reliever permitting introduction of slack into the shoulder belt, said junction ring comprising:

a frame having spaced apart upstanding flanges defining slots and a tongue portion adapted for engagement by the buckle, a pin movably mounted on the frame by the slots for movement toward and away from the buckle and having the continuous-loop belt passing therearound, a friction member movably mounted on the frame and having a friction face engageable with the continuous-loop belt and an abutment portion engageable by the buckle upon engagement of the junction ring with the buckle, spring means urging extension of the friction member from the junction ring frame to extend the abutment portion to an extended position projecting from the junction ring for subsequent engagement by the buckle and retraction into the junction ring upon engagement of the junction ring with the buckle, spring means urging the pin in the direction toward the buckle and the friction member so that the continuous-loop belt is frictionally clamped between the pin and the friction member when the friction member is retracted upon engagement of the junction ring with the buckle to provide a one-way friction detent which prevents transference of tension relieving slack from the shoulder belt portion into the lap belt portion so that the lap belt portion remains taut about the occupant, said spring means yielding upon the onset of an occupant restraint load on the lap and shoulder belt portions to permit movement of the pin away from the buckle and away from the friction member so that the continuous-loop belt is permitted to pass freely around the pin and through the junction ring to adjust the relative restraint lengths of the lap and shoulder belt portions during restraint of the seated occupant.

* * * * *